United States Patent [19]

Yamamoto et al.

[11] Patent Number: 4,582,314

[45] Date of Patent: Apr. 15, 1986

[54] PAPER FEEDING APPARATUS

[75] Inventors: Takemi Yamamoto; Susumu Kuzuya; Isao Kagami; Yuuichi Takenaka, all of Nagoya, Japan

[73] Assignee: Brother Kogyo Kabushiki Kaisha, Nagoya, Japan

[21] Appl. No.: 544,140

[22] Filed: Oct. 21, 1983

[30] Foreign Application Priority Data

Nov. 19, 1982 [JP] Japan ..... 57-203897
Nov. 19, 1982 [JP] Japan ..... 57-176195[U]

[51] Int. Cl.[4] ..... B65H 1/12; B65H 3/06

[52] U.S. Cl. ..... 271/127; 271/4; 271/160

[58] Field of Search ..... 271/117, 126, 127, 157, 271/158, 159, 160, 4, 162, 164, 170, 171; 400/624, 625, 629

[56] References Cited

U.S. PATENT DOCUMENTS

| | | | |
|---|---|---|---|
| 2,735,669 | 2/1956 | Seiler | 267/172 |
| 2,891,784 | 6/1959 | Taylor | 267/172 |
| 3,563,535 | 2/1971 | Vitu et al. | 271/157 |
| 4,280,692 | 7/1981 | Hutchinson et al. | 271/127 |
| 4,343,461 | 8/1982 | Tomimori et al. | 271/171 |

FOREIGN PATENT DOCUMENTS

| | | | |
|---|---|---|---|
| 0146673 | 9/1982 | Japan | 400/624 |

OTHER PUBLICATIONS

Goff et al., "IBM Technical Disclosure Bulletin", Aug. 1974, vol. 17, No. 3.

*Primary Examiner*—Bruce H. Stoner, Jr.
*Assistant Examiner*—Alvin Oberley
*Attorney, Agent, or Firm*—Browdy and Neimark

[57] ABSTRACT

A paper feeding apparatus for a printer, comprising feed rollers to feed sheets of paper in a direction across a line of printing, a paper stacker holding the sheets in a stack and movable between an advanced and a retracted position, a biasing device for biasing the paper stacker toward its advanced position to urge a top sheet of the paper stack into contact with the feed rollers, a manually operated member movable between a first and a second position, a retract-and-latch device for moving the paper stacker to the retracted position against a biasing force of the biasing device and locking the paper stacker at the retracted position when the manually operated member is moved from the first to the second position, and an unlatch device for releasing the retract-and-latch device to allow the paper stacker to return to the advanced position when the manually operated member is moved toward its first position. Also disclosed is a pressure adjusting device for adjusting the biasing force of the biasing device depending upon a specific kind of the sheets on the paper stacker.

19 Claims, 8 Drawing Figures

FIG. 4
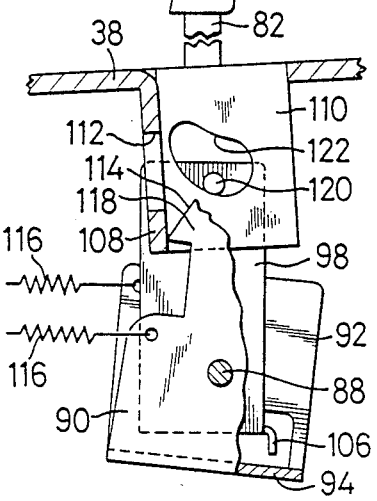
FIG. 5
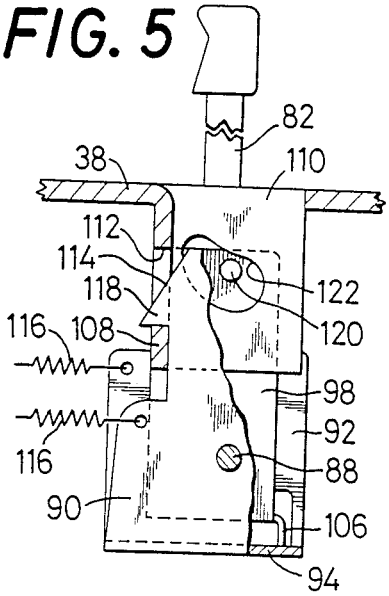
FIG. 6
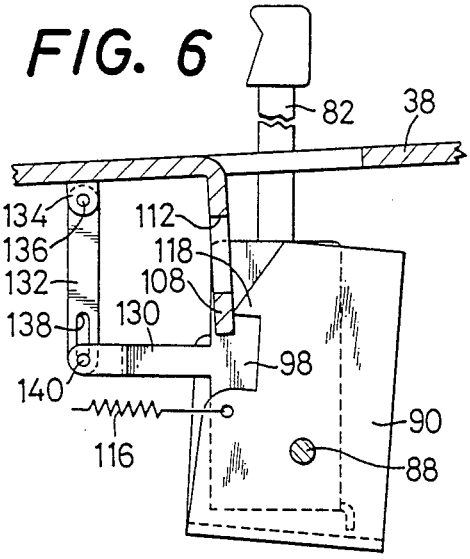
FIG. 7
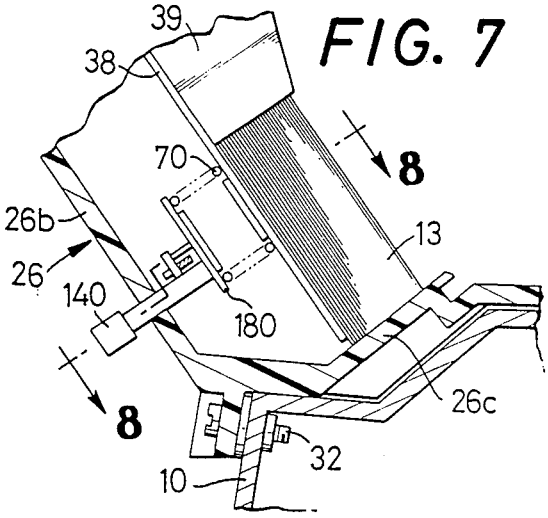
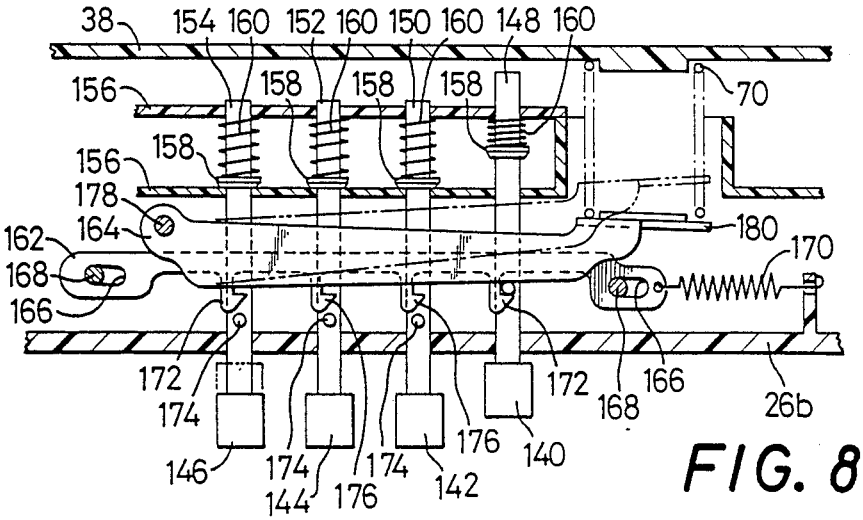
FIG. 8

PAPER FEEDING APPARATUS

BACKGROUND OF THE INVENTION

The present invention relates in general to improvements in a paper feeding apparatus for a printer for feeding individual sheets of paper from a paper stacker or storage tray toward a printing assembly, and more particularly to improvements associated with the paper stacker for easy loading of a stack of paper on the stacker and stable, smooth feeding of sheets of various thicknesses.

A paper feeding apparatus is known in the art, which comprises a frame secured to a typewriter or printer, feed rollers supported on the frame rotatably to feed individual sheets of paper, a paper stacker supported by the frame movably relative to the feed rollers and holding the sheets of paper in a stack, and biasing means for biasing the paper stacker to urge the top of the paper stack into contact with the feed rollers. In such paper feeding apparatus, the sheets of paper are fed from the stacker one after another with the rotating feed rollers kept in frictional contact with the top sheet of the paper stack on the stacker by the biasing means. Upon re-loading the stacker with a new stack of paper, it is generally required to move the stacker to its retracted position against an urging force of the biasing means, re-load the stacker and return the stacker to its normal advanced position at which the top sheet of the paper stack is urged against the feed rollers. To this end, it has been attempted to provide such known feeding apparatus with means for locking the paper stacker at its retracted position. However, such means is not simple in construction and operation for moving the stacker against the resiliency of the biasing means and unlocking the stacker after it has been re-loaded with a new stack of paper. Thus, there has been a need of providing a paper feeding apparatus for a printer with simplified latch and unlatch means for moving its paper stacker to its retracted position, holding the stacker at the same position and releasing the newly loaded stacker, which means is easily operable by a wide variety of users who are familiarized in varying degrees with the printer.

In the meantime, it is recognized that a paper stacker is required to accommodate various kinds of sheets, e.g., sheets of different thicknesses. In this respect, the known paper feeding apparatus as previously described has another problem that its action of feeding one sheet at a time is not stable for all thicknesses of paper that are stored in the stacker. More specifically, when the stacker is loaded with thin sheets of paper the feed rollers tend to feed two or more sheets at one time. Conversely, the feed rollers are likely to fail in feeding a sheet in correct manner when the paper is comparatively thick.

SUMMARY OF THE INVENTION

It is accordingly an object of the present invention to provide a paper feeding apparatus having a simple device which is easily operated with a single manually operated member and capable of retracting a paper stacker, locking the same at its retracted position and releasing the locked stacker upon completion of loading the stacker with a new stack of paper.

Another object of the invention is to provide a paper feeding apparatus which is capable of stable and smooth paper feeding one sheet at a time from a paper stacker, for a relatively wide range of thickness of the paper.

According to the invention, there is provided a paper feeding apparatus for a printer for impression of characters along a line of printing. The apparatus comprises a frame secured to the printer, at least one feed roller supported by the frame rotatably to feed individual sheets of paper one after another in a direction perpendicular to the line of printing, and a paper stacker supported by the frame and holding the sheets of paper in a stack. The paper stacker being movable between an advanced and a retracted position thereof. The apparatus further comprises biasing means for biasing the paper stacker toward the advanced position to urge a top sheet of the stack into contact with a periphery of the at least one feed roller, a manually operated member supported by the frame movably between a first and a second position thereof, retract-and-latch means associated with the manually operated member for moving the paper stacker to the retracted position against a biasing force of the biasing means and locking the paper stacker at the retracted position when the manually operated member is moved from the first position to the second position, and unlatch means for releasing the retract-and-latch means to allow the paper stacker to return to the advanced position when the manually operated member is moved from the second position back to the first position.

In the paper feeding apparatus constructed as stated above, the movement of the manually operated member from the first position to the second position will cause the retract-and-latch means to move the paper stacker to its retracted position and lock the same at this position. The reverse movement of the manually operated member toward its first position will cause the unlatch means to release the retract-and-latch means to allow the paper stacker to return to the advanced position at which the top sheet of the paper stack on the stacker is urged against the feed roller. Thus, a simple manipulation of the manually operated member between the first and second positions permits considerably easy latching of the paper stacker to hold the same free from the biasing force and unlatching of the same to restore it to its operative position. Further, these different steps of operations are effected with a simple structural arrangement.

According to the instant invention, there is also provided a paper feeding apparatus for a printer for impression of characters along a line of printing. The apparatus comprises a frame secured to the printer, at least one feed roller supported by the frame rotatably to feed individual sheets of paper one after another in a direction perpendicular to the line of printing, and a paper stacker supported by the frame and holding the sheets of paper in a stack. The paper stacker is movable between an advanced and a retracted position thereof. The apparatus further comprises biasing means for biasing the paper stacker toward the advanced position to urge a top sheet of the stack into contact with a periphery of the at least one feed roller, and pressure adjusting, means for adjusting a biasing force of the biasing means depending upon a specific kind of the sheets of paper.

With the above arrangement, the biasing force applied to the paper stacker is easily adjustable with the pressure adjusting means so that the top sheet of the paper stack on the stacker is urged with an optimum force against the feed roller, whereby the individual sheets are correctly fed one sheet at a time irrespective of a specific thickness of the paper stacked on the stacker.

BRIEF DESCRIPTION OF THE DRAWINGS

The above and other objects, features and advantages of the present invention will become more apparent from reading the following description of the preferred embodiments taken in connection with the accompanying drawings in which:

FIGS. 4 and 5 are views showing two operating positions of the device of FIG. 3;

FIG. 6 is a view, similar to FIG. 4, of another embodiment of the invention;

FIG. 7 is a view, similar to FIG. 2, of a further embodiment of the invention; and FIG. 8 is is a cross sectional view taken along line 8—8 of FIG. 7.

DETAILED DESCRIPTION OF THE PREFERRED EMBODIMENTS

Figure 1:
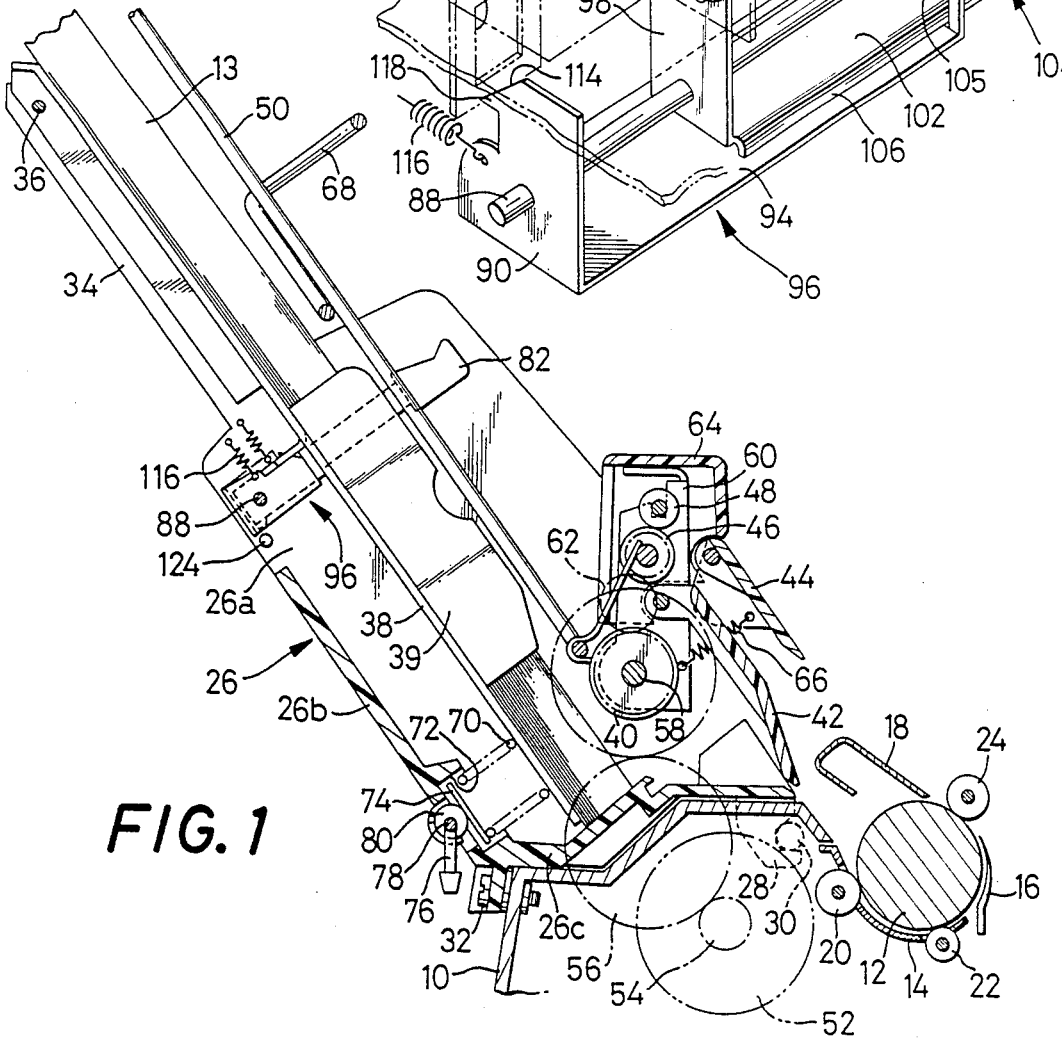
FIG. 1 is a side elevational view in cross section of one embodiment of a paper feeding apparatus of the present invention.

Referring first to FIG. 1, there is shown a well known platen 12 which is rotatably supported on a typewriter frame 10. Around the circumference of the platen 12 are disposed a paper guide pan 14, a card-holder 16 and a guide plate 18 in order to guide a sheet of paper 13. Guide rollers 20, 22, 24 are arranged in mutually spaced relation circumferentially of the platen 12 to urge the sheet 13 against the circumferential surface of the platen 12. A keyboard not shown is provided on one side of the platen 12, and a paper feeding apparatus is disposed on the other side opposite to the keyboard. The paper feeding apparatus includes a frame 26 which comprises a pair of side plates 26*a* on the right and left sides of the apparatus, a back plate 26*b* connecting the right and left side plates 26*a*, and a bottom plate 26*c*. The frame 26 has retainer hooks 28 which extend from the bottom plate 26*c* to engage attaching pins 30 secured to the typewriter frame 10. In this condition, fixing screws 32 are tightened to fix the frame 26 to the frame 10 such that the frame 26 is inclined.

The pair of side plates 26*a* are provided with extensions 34 which extend from upper ends of the plates 26*a* in an obliquely upward direction, i.e., in a direction parallel to the back plate 26*b*. The paper feeding apparatus includes a first paper stacker 38 in the form of a paper receiver plate which is pivotable about a pin 36 spanning free ends of the extensions 34. The first paper stacker 38 is equipped with right and left guide walls 39 to prevent sidewise collapse of a stack of paper 13 on the receiver plate 38. The bottom edge of the paper stack abuts on the bottom plate 26*c*. Thus, the bottom plate 26*c* and the side walls 39 cooperate with the receiver plate 38 to form a first paper storage tray. The top sheet of the paper stack 13 on the first paper stacker 38 is adapted to be urged against feed rollers 40, whereby the paper sheets 13 are fed toward the platen 12 one after another through rotation of the feed rollers 40. The sheet of paper 13 which has been fed to the nip of the platen 12 and the guide rollers 20, is then advanced through rotation of the platen 12 while it is guided by the guide pan 14 and card-holder 16. The leading portion of the sheet 13 guided by the guide plate 18 above the platen 12 is then guided between first and second paper guides 42 and 44 to pass through the nip of a pair of ejection rollers 46 and 48 which transfer the sheet 13 onto a second paper stacker 50 secured to the side plates 26*a*. The platen 12 is driven by a motor 52 mounted on the frame 10 through a pinion 54 and an intermediate gear (not shown) engaging the pinion 54. The feed rollers 40 are mounted on a pinion drive shaft 58 which is driven through an intermediate gear 56 engaging the pinion 54, so that the feed rollers 40 are driven in the same direction as the platen 12.

The ejection rollers 46 and 48 are rotatably supported by an ejector frame 60 which is pivotable about the drive shaft 58. These rollers 46 and 48 are driven by the drive shaft 58 through an intermediate gear 62. The ejector frame 60 carries a covering frame 64 of synthetic resin which supports the previously described second paper guide 44 so that the guide 44 is pivotable about its conneceted end. Similarly, the first paper guide 42 is pivotably supported by the ejector frame 60. These two paper guides 42 and 44 are biased toward the typewriter frame 10 by a spring 66 disposed under tension between the second paper guide 42 and the ejector frame 60. With the above arrangement, a pivotal movement of the ejector frame 60 about the drive shaft 58 toward the second paper stacker 50 will cause the first and second paper guides 42 and 44 to pivot relative to the ejector frame 60 toward the typewriter frame 10, with a result of closing a paper exit path formed between the two guides 42 and 44, whereby an ample open space is formed in front of a substantially flat surface defined by the first and second paper guides 42 and 44 and the covering frame 64. In other words, this substantially flat surface defines a paper inlet path leading to a space between the guide plate 18 and the typewriter frame 10. In this condition wherein the paper feeding apparatus is inoperative with the ejector frame 62 pivoted to form the paper inlet path, the operator may easily insert a desired sheet manually along the inlet path toward the platen 12. Reference numeral 68 indicates a anti-warp wire secured to the second paper stacker 50 to prevent the printed sheets 13 on the second paper stacker 50 from warping away from the stacker.

Figure 2:
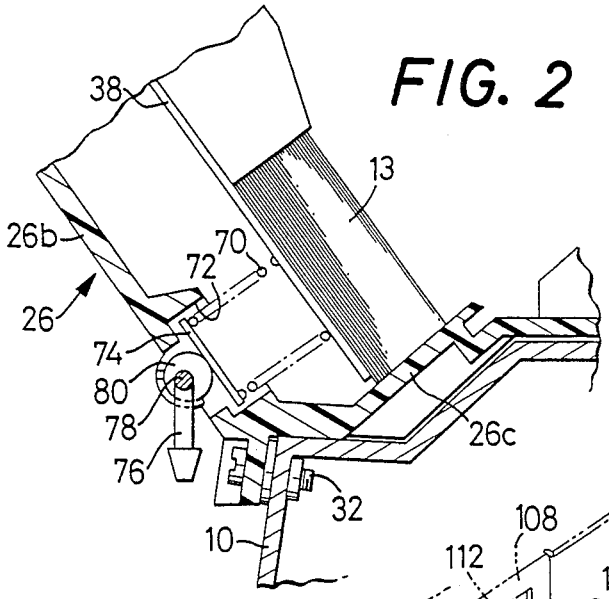
FIG. 2 is an enlarged cross sectional view of a part of the apparatus of FIG. 1.

As previously indicated, the stack of paper 13 on the first paper stacker 38 is urged onto the feed rollers 40 by two springs 70 which are interposed between the frame 26 and the first paper stacker 38. More specifically stated, two retainer holes 72 are formed in the back plate 26*b* at two positions spaced from each other along the width of the sheet 13. The springs 70 are retained at their one end in the respective retainer holes 72 so that the other end abuts on the back of the first paper stacker 38 to urge the top sheet of the paper stack 13 into contact with the periphery of the feed rollers 40. The biasing or urging force of the springs 70 are adjustable through a pressure adjusting device, depending upon a specific kind of the sheets 13 in terms of thickness and other properties thereof. A detailed structure of an exemplary device is shown in FIG. 2 wherein a spring seat 74 of disc shape is disposed in each of the retainer holes 72 to bear said one end of the spring 70. The spring seat 74 is kept in contact with an eccentric cam 80 secured to a shaft 78 which is rotatably supported by the frame 26. The eccentric cam 80 is rotated with the shaft 78 by a manually operated pressure adjusting lever 76 which is fixed to the shaft 78. When the eccentric cam 80 is rotated by the adjusting lever 76, an external peripheral cam surface of the cam 80 which bears the spring seat 74 will have a sliding contact with the back surface of the spring seat 74, thereby changing a position of the seat 74 relative to the paper stacker 38, and consequently adjusting the biasing force of the spring 70 applied to the paper stacker 38.

When the paper stacker 38 is loaded with relatively thick sheets of paper 13, for example, the adjusting lever 76 is thrown downwardly to rotate the eccentric cam 80 in a direction that will cause the cam surface to move the spring seat 74 toward the paper stacker 38, thereby increasing the biasing force of the springs 70 with a result of giving the top sheet of the paper stack an increased urging pressure against the feed rollers 40. The increase in the urging pressure assures stable feeding of the thick paper one sheet at a time. This operating position of the pressure adjusting device is shown in FIGS. 1 and 2.

When the paper stacker 38 is loaded with relatively thin sheets of paper 13, on the contrary, the adjusting lever 76 is thrown upwardly, for example, about 90 degrees from the position of FIG. 2. With the rotary movement of the eccentric cam 80 by this throw of the lever 76 will cause the cam surface to allow a movement of the spring seat 74 toward the back plate 26*b*. As a result, the biasing force of the springs 70 and consequently the urging pressure of the sheet 13 against the feed rollers are decreased to prevent otherwise possible simultaneous feeding of two or more superposed sheets, i.e., assure stable feeding of the thin paper one sheet at a time. Thus, the pressure adjusting device or means is constituted by the eccentric cam 80, manually operated adjusting lever 76, spring seat 74, etc.

The paper feeding apparatus is also provided with a device for holding the first paper stacker 38 free from the biasing force of the springs 70. This device comprises: a manually operated lever 82 supported by the frame 26 pivotably between its first and second positions; retract-and-latch means for moving the paper stacker 38 against the biasing force of the springs 70 from its advanced operative position to its retracted inoperative position and locking the paper stacker 38 at the retracted position when the manually operated lever 82 is moved from its first position to its second position; and unlatch means for releasing the retract-and-latch means to allow the paper stacker 38 to return to its advanced operative position when the manually operated lever 82 is moved from the second position toward the first position. The advanced position is defined as a position at which the top sheet of the paper stack 13 on the stacker 38 is in contact with the feed rollers, and the retracted position is defined as a position spaced from the feed rollers 40 toward the back plate 26*b* a distance sufficient for loading the paper stacker with a stack of paper 13.

Figure 3:
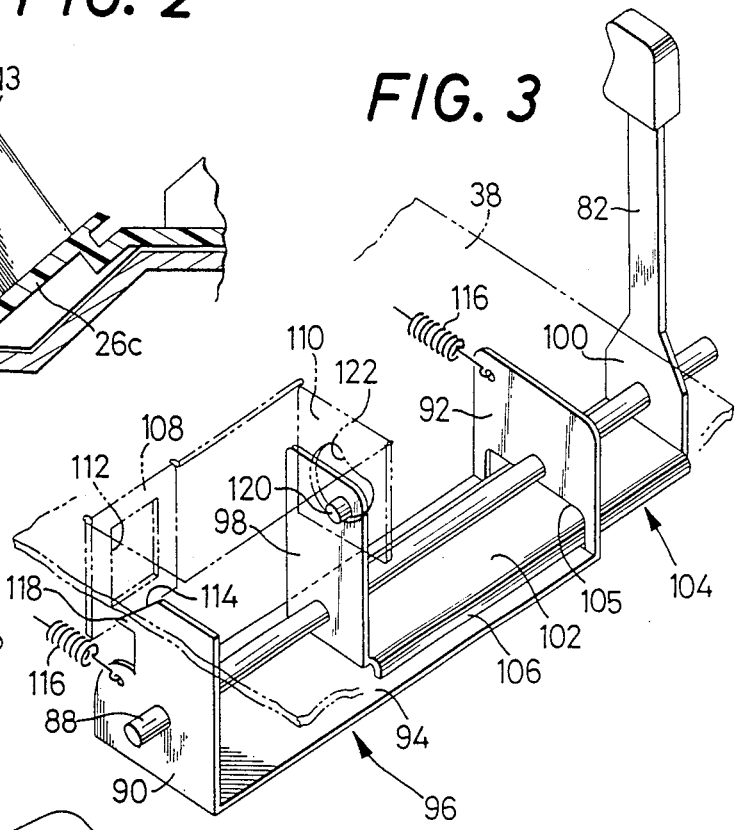
FIG. 3 is a perspective view in enlargement of another part of the apparatus of FIG. 1.

Stated in more detail referring to FIG. 3, two pivotable members 96 and 104 are supported by a support rod or shaft 88 which is rotatably supported by the right and left side plates 26*a*, so that the two members are pivotable about the common shaft 88. The pivotable member 96 comprises two spaced-apart opposed side walls 90 and 92 and a generally planar connecting portion 94 connecting the two side walls 90, 92 at their lower ends. Likewise, the pivotable member 104 comprises two spaced-apart opposed side walls 98 and 100 and a generally planar connecting portion 102 connecting the two side walls 98, 100 at their lower ends. The support shaft 88 extends through the side walls 90, 92, 98 and 100 such that the four walls are spaced from each other along the length of the shaft 88. The side wall 100 of the pivotable member 104 terminates in the manually operated lever 82. The side wall 92 of the pivotable member 96 has at its lower portion an opening 105 through the thickness thereof. The planar connecting portion 102 extends through the opening 105 in parallel to the plane of the planar connecting portion 94. The two connecting portions are spaced from each other in a direction perpendicular to their respective planes so that the two pivotable members 96 and 104 are pivotable relative to each other about the common shaft 88. Thus, the side wall 92 of the pivotable member 94 is disposed between the side walls 98 and 100 of the pivotable member 104, and the side wall 98 of the pivotable member 104 is disposed between the side walls 90 and 92 of the pivotable member 94. The connecting portion 102 has a downward extension in the form of a lip 106 which is formed by bending one side edge of the connecting porton 102 downwardly toward the connecting portion 94. Upon turning the manually operated lever 82 clockwise (as viewed in FIG. 3) from its second position to its first normal position, the pivotable member 104 will pivot from its latch position to its release position and the lip 106 extending from the connecting portion 102 will abut on the surface of the connecting portion 94, thereby causing the pivotable member 96 to pivot together with the pivotable member 104.

The first paper stacker 38 is provided at its central part with first and second engagement sections 108 and 110 which are formed by cutting and folding portions of the stacker 38 such that the sections 108 and 110 extend adjacent the side walls 90 and 98. The first engagement section 108 which is perpendicular to the plane of the side wall 90, has an internal rectangular cutout 112. The side wall 90 has, at its corner adjacent the engagement section 108, an inclined surface 114 which partially defines a generally triangular hook 118 engageable with the rectangular cutout 112. When the first paper stacker 38 is pivoted against the biasing force of the springs 70, the lower edge of the first engagement section 108 abuts on the inclined surface 114, causing the pivotable member 96 to pivot against a biasing force of a spring 116, whereby the hook 118 is finally put into engagement with the rectangular cutout 112. Thus, the paper stacker 38 is locked at its retracted position with the first engagement section 108 latched to the side wall 90.

The second engagement section 110 which is parallel to the side wall 98, has a cam groove 122 which engages a cam follower in the form of a pin 120 provided at the upper part of the side wall 98. When the manually operated lever 82 is pivoted counterclockwise (as viewed in FIG. 3) from its first position to its second position, the second engagement section 110 is pulled through the action of the follower pin 102 and the cam groove 122, whereby the paper stacker 38 is pivoted about the pin 36 against the biasing force of the springs 70, and the first engagement section 108 is latched to the side wall 90 as previously discussed. Reference numeral 124 designates a stop which limits a pivotal movement of the pivotable member 96 against the spring 116.

As described hereinbefore, the retract-and-latch means comprises: the two pivotable members 96 and 104; first linkage means including the second engagement section 110 (cam groove 122) and the side wall 98

(pin 120); the first engagement section 108 (cutout 112); and the side wall 90 (hook 118).

The device for locking the paper stacker 38 at the retracted position constructed as described above, is operated in the following manner.

When the sheets of paper 13 on the paper stacker 38 have been almost fed out for printing, the paper stacker 38 is located adjacent the feed rollers 40. To re-load the stacker 38 with a new stack of paper 13, therefore, the stacker 38 must be retracted to provide an ample space between the first and second stackers 38 and 50. FIG. 4 shows the position of the device when the paper stacker 38 is located at its fully advanced position.

Upon counterclockwise movement of the manually operated lever 82 from its first position of FIG. 4 toward its second position of FIG. 5, the first paper stacker 38 is pivoted against the biasing force of the springs 70 through the action of the pin 120 associated with the cam groove 122. As a result, the hook 118 of the pivotable member 96 is put into engagement with the rectangular cutout 112 of the first engagement section 108 through the aid of the spring 116. Thus, the first paper stacker 38 is locked at its retracted position through engagement of the first engagement section 108 with the side wall 90 of the pivotable member 96, as shown in FIGS. 1 and 5. In this condition, an ample space is maintained between the first and second paper stackers 38 and 50, thus enabling the operator to insert a new stack of paper 13 into the formed space and place the paper stack in position on the stacker 38.

After completion of the placement of the new stack of paper 13 on the first paper stacker 38, the lever 82 is turned clockwise (in FIG. 5) toward its first position. With the pivotal movement of the pivotable member 104, the lip 106 abuts on the connecting portion 94 and consequently causes the pivotable member 96 to pivot in the same direction, whereby the side wall 90 is separated from the first engagement section 108 with the hook 118 disengaged from the cutout 12. Therefore, the paper stacker 38 is pivoted by the springs 70 toward the feed rollers 40 and the top sheet of the paper stack 13 on the stacker 38 is urged into contact with the periphery of the feed rollers 40. Thus, it is understood that the lip 106 and the connecting portion 94 cooperate to form second linkage means which serves as the previously indicated unlatch means for releasing the retract-and-latch means when the manually operated lever 82 is moved towards its first position.

As is apparent from the foregoing description, the holding device shown in FIGS. 3–5 is capable of locking the first paper stacker 38 at its retracted position by turning the lever 82 to its second position, and releasing the stacker 38 from the retract-and-latch means by returning the lever 82 to its first position. Stated the other way, a simple manipulation of a single lever permits quick and sure locking and unlocking of the first paper stacker 38. Further, the retract-and-latch means and the unlatch means are simply constructed and consequently economical to manufacture.

Referring next to FIG. 6, there is illustrated another embodiment of a holding device alternative to the device of FIGS. 3–5. For convenience, the same reference numerals are used in FIG. 6 to identify the corresponding parts, and the following description is limited to such parts which are associated with variations or modifications of the preceding embodiment.

There is shown in FIG. 6 the side wall 98 which is formed with a lever arm 130 extending therefrom substantially in parallel to the bottom of the first paper stacker 38. The free end of the lever arm 130 is coupled to the paper stacker 38 by a connecting link 132 which is connected at one end pivotably about a pin 136 to a connecting lug 134 provided on the paper stacker 38. The connecting link 132 is provided at the other end with an elongate hole 138 formed along the length thereof for engagement with a pin 140 provided on the free end of the lever arm 130.

With the above described arrangement, a movement of the lever arm 130 caused by a pivotal movement of the manually operated lever 82 toward its second position will be transmitted to the paper stacker 38 through the connecting link 132 to cause the paper stacker 38 to move toward its retracted position. To the contrary, a reverse movement of the lever arm 130 caused by a movement of the lever 82 back to its first position will not influence the position of the paper stacker 38 because the movement of the lever arm 130 at its free end is absorbed by the elongate hole 138 formed in the connecting link 132. In other words, the pivotable member 104 is pivoted toward its release position without a movement of the paper stacker 38 toward its advanced position until the lip 106 abuts on the connecting portion 94 to release the locked paper stacker 38 as previously discussed.

In this embodiment, the connecting link 132 coupled to the lever arm 130 constitutes first linkage means corresponding to the cam groove 122 and the follower pin 120 of the preceding embodiment. This alternative first linkage means is advantageous in that a slight movement of the manually operated lever 82 toward its second position will produce a comparatively large amount of movement of the paper stacker 38 toward its retracted position.

Referring to FIGS. 7 and 8, a modified embodiment of a pressure adjusting device alternative to the device of FIG. 2 will be described. For convenience, the same reference numerals are used to identify the corresponding parts.

The modified pressure adjusting device which is disposed between the paper stacker 38 and the back plate **26*b* of the frame 26 as shown in FIGS. 7 and 8, is capable of adjusting an urging force of the paper 13 against the feed rollers 40 in four steps through manipulation of four pushbuttons 140, 142, 144 and 146. These pushbuttons are supported by respective push rods 148, 150, 152 and 154 which are spaced from each other in a direction across the length thereof and extend through opposed support plates 156 fixed to the frame 126 and through the back plate 26*b*. Thus, the push rods are supported by those plates 156, 26*b* freely movably along the length thereof. The push rods 148, 150, 152 and 154 are biased, in a direction from the supports plates 156 toward the back plate 26*b*, by respective springs 160 which are wound around portions of the rods between the opposed support plates 156. The push rods are provided with stoppers 158 which bear one end of the springs 160 and serve to limit a distance of projection of the rods away from the back plate 26*b* under a biasing force of the springs 160. An elongate detent member 162 is disposed between the back plate 26*b* and the support plate assembly 156 so as to extend across the push rods 148, 150, 152 and 154 and in parallel to the back plate 26*b*. Adjacent the elongate detent member 162 is disposed an elongate pivotable member 164 so as to be partly superposed on the elongate detent member 162**.

The elongate detent member 162 has at its opposite ends elongate holes 166 formed along the length thereof. These elongate holes 166 slidably receive respective pins so that the elongate detent member 162 is supported movably along its length. The detent member 162 is biased by a spring 170 in one longitudinal direction (to the right as viewed in FIG. 8). The detent member 162 has four parallel extensions 172 which extend adjacent and in parallel to the respective push rods 148, 150, 152 and 154. The parallel extensions 172 terminate in hooked ends which are engageable with respective engagement pins 174 provided on the push rods 148, 150, 152 and 154. Each of the hooked ends of the parallel extensions 172 has an inclined surface 176 which, upon sliding contact with the engagement pin 174, serves to move the elongate detent member 162 longitudinally against the biasing force of the spring 170.

The elongate pivotable member 164 is pivotably supported by a pin 178 at one end thereof, and carries at the other end a spring seat 180 having a surface substantially parallel to the bottom of the paper stacker 38. Between the spring seat 180 and the paper stacker 38 are disposed the previously described springs 70 to urge the top sheet of the paper stack 13 into contact with the feed rollers 40.

In the pressure adjusting device constructed as described above, the biasing force of the springs 70, and consequently the pressure between the paper stack 13 and the feed rollers 40 are adjusted in the following manner. When the stack of sheets 13 is formed of thin paper, e.g., 40-Kg paper, the pushbutton 140 is depressed. In this instance, an axial movement of the push rod 148 will cause its engagement pin 174 to engage the hooked end of the extension 172. Thus, the engagement pin 174 on the push rod 148 is held in abutting contact with the side edge of the elongate pivotable member 164, thereby limiting a pivotal movement of the pivotable member 164, i.e., the position of the spring seat 180 relative to the paper stacker 38. FIG. 8 shows, in solid lines, the position of the spring seat 180 when the pushbutton 140 has been depressed, that is, the position at which the biasing force is set at the minimum level.

In the case where the paper stacker 38 is loaded with a stack of thick paper, for example, 70-Kg paper, the pushbutton 146 is depressed. With this depression, the engagement pin 174 on the push rod 154 forcibly slides on the inclined surface 176 of the hooked end of the extension 172, whereby the elongate detent member 162 is moved to the left as viewed in FIG. 8 against the force of the spring 170. The leftward movement of the detent member 162 causes the engagement pin 174 on the push rod 148 to disengage from the corresponding hooked end, thus allowing the push rod 148 and the pushbutton 140 to return to their original position under the force of the spring 160. Upon further depression of the pushbutton 146, the engagement pin 174 on the push rod 154 is put into engagement with the corresponding hook end of the extension 172, and held in abutting contact with the side edge of the pivotable member 164. As a consequence, the pivotable member 164 is pivoted against the force of the springs 70 to a position shown in phantom lines in FIG. 8. At this position, the biasing force of the sprins 70 is set at the highest level. When the paper 13 is medium in thickness, e.g., 50- or 60-Kg paper, the pushbutton 142 or 144 is manipulated for pivotal movement of the pivotable member 164 to the corresponding position to adjust the biasing force of the springs 70 to the appropriate levels for such different kinds of paper 13. As is apparent from the foregoing description, the distances between the side edge of the pivotable member 164 and the individual engagement pins 174 are so determined that the biasing forces are adjustable depending upon the pushbuttons 140, 142, 144 and 146 which are operated.

Like the adjusting device of FIG. 2, the modified form of the pressure adjusting device of FIGS. 7 and 8 is capable of selectively establishing a biasing force of the springs 70 suitable to the specific thickness or other properties of the paper 13, and thus assuring stable feeding of individual sheets of different kinds. An advantageous difference of this modified device over the device of FIG. 2 resides in the adjustment of the biasing force in multiple steps through simple operation of the corresponding pushbuttons.

While the present invention has been described in its preferred embodiments referring to the accompanying drawings, it is to be understood that the invention is not limited thereto, but may be otherwise embodied.

For example, the first linkage means (120 and 122) of the embodiment of FIGS. 3–5 may be constituted by a cam groove formed in the side wall 98 and a follower pin provided on the second engagement section 110. Similarly, the second linkage means (94 and 106) may include an extension from the connecting portion 94, rather than the lip 106 extending from the connecting portion 102.

Further, the push rods 148, 150, 152 and 154 of FIG. 8 which are actuated by manual operation of the corresponding pushbuttons 140, 142, 144 and 146, may be automatically operated by solenoids which are controlled by electric signals to permit automatic selection of an optimum urging pressure of the paper stack onto the feed rollers 40 according to the specific kind of the paper 13.

Other modifications and alterations may be made in connection with the biasing means, pressure adjusting means, retract-and-latch means, unlatch means, etc., within the scope of the invention defined by the appended claims.

What is claimed is:

1. A paper feeding apparatus for a printer for impression of characters along a line of printing, comprising:

a frame secured to the printer;

at least one feed roller supported by said frame rotatably to feed individual sheets of paper one after another in a direction perpendicular to said line of printing;

a paper stacker supported by said frame and holding said sheets of paper in a stack, said paper stacker being movable between an advanced position and a retracted position, and including an engagement portion;

biasing means for biasing said paper stacker toward said advanced position to urge a top sheet of said stack into contact with a periphery of said at least one feed roller;

a manually operated member movably supported by said frame between a first and a second position thereof;

retract-and-latch means comprising (a) a first movable member, (b) a second movable member having a latch portion and movable independently of said first movable member, and (c) first linkage means associated with said paper stacker, said first movable member being connected to said manually operated member and movable between a release position and a latch position when said manually operated member is moved between said first and second positions, respectively, said paper stacker and said first movable member being operatively connected to each other through said first linkage means such that said paper stacker is moved to said retracted position against a biasing force of said biasing means when said first movable member is moved to said latch position upon movement of said manually operated member to said second position, said latch portion of the second movable member being engageable with said engagement portion of the paper stacker to lock the paper stacker at said retracted position when said first movable member is moved to said latch position; and unlatch means comprising second linkage means for moving said second movable member in a direction that causes said latch portion to disengage from said engagement portion of the paper stacker when said first movable member is moved toward said release position.

2. A paper feeding apparatus as recited in claim 1, wherein said first linkage means comprises a cam provided on one of said first movable member and said paper stacker, and a cam follower provided on the other.

3. A paper feeding apparatus as recited in claim 1, wherein said first linkage means comprises a link pivotably connected by pins at opposite ends thereof to said first movable member and said paper stacker, said link having at one of said ends an elongate hole engageable with the corresponding pin and thereby allowing said first movable member to move a given amount while said paper stacker is held in said retracted position.

4. A paper feeding apparatus as recited in claim 1, wherein said latch portion of the second movable member comprises a hook and said engagement portion of the paper stacker has a cutout engageable with said hook.

5. A paper feeding apparatus as recited in claim 1, wherein said second linkage means comprises an extension of one of said first and second movable members, said extension being abuttable on the other of said first and second movable members.

6. A paper feeding apparatus as recited in claim 1, wherein said first movable member is a first pivotable member supported pivotably between said release and latch positions, and said second movable member is a second pivotable member supported pivotably to cause said latch portion to be engageable with and disengageable from said engagement portion.

7. A paper feeding apparatus as recited in claim 6, wherein said first and second pivotable members are both supported by and pivotable about a common shaft.

8. A paper feeding apparatus as recited in claim 7, wherein said first pivotable member comprises a first connecting portion and a first pair of side wall portions connected by said first connecting portion and spaced from each other along said common shaft, said second pivotable member comprising a second connecting portion and a second pair of side wall portions connected by said second connecting portion and spaced from each other along said common shaft, said common shaft extending through the thickness of said first and second pairs of side wall portions such that one of said first pair of side wall portions is disposed between said second pair.

9. A paper feeding apparatus as recited in claim 8, wherein said one of said first pair of side wall portions is associated with said first linkage means, one of said second pair of side wall portions having said latch portion.

10. A paper feeding apparatus as recited in claim 8, wherein said first and second connecting portions are of planar shape, one of said second pair of side wall portions has an opening across the thickness thereof, said first connecting portion extending through said opening and spaced from said second connecting portion in a direction perpendicular to respective planes thereof such that said first and second pivotable members are pivotable relative to each other about said common shaft.

11. A paper feeding apparatus as recited in claim 10, wherein said second linkage means comprises a lip extending from said first connecting portion toward said second connecting portion and spaced from the axis of said common shaft in a plane of said first connecting portion.

12. A paper feeding apparatus as recited in claim 10, wherein said one of said first pair of side wall portions is associated with said first linkage means and the other is connected to said manually operated member, the other of said second pair of side wall portions including a hook engageable with said engagement portion of said paper stacker.

13. A paper feeding apparatus as recited in claim 1, wherein said second movable member is spring-biased in a direction that causes said latch portion to engage with said engagement portion.

14. A paper feeding apparatus as recited in claim 1, further comprising:

pressure adjusting means for adjusting a biasing force of said biasing means depending upon a specific kind of said sheets of paper.

15. A paper feeding apparatus as recited in claim 14, wherein said biasing means comprises a spring having one end in abutment on said paper stacker to urge the same toward said at least one feed roller, and a spring seat bearing the other end of said spring, said pressure adjusting means including a rotatably supported cam having an external peripheral cam surface, and further including a manually operated member to rotate said cam, said cam surface bearing said spring seat in sliding contact with the same, thereby changing a position of said spring seat and consequently said biasing force upon rotation of said cam by said manually operated member.

16. A paper feeding apparatus for a printer for impression of characters along a line of printing, comprising:

a frame secured to the printer;

at least one feed roller rotatably supported by said frame to feed individual sheets of paper one after another in a direction perpendicular to said line of printing;

a paper stacker supported by said frame and holding said sheets of paper in a stack, said paper stacker being movable between an advanced and a retracted position thereof;

biasing means comprising a spring for biasing said paper stacker toward said advanced position, said spring having one end in abutment on said paper stacker to urge a top sheet of said stack into contact with a periphery of said at least one feed roller, and further comprising a spring seat bearing the other end of said spring; and pressure adjusting means for adjusting a biasing force of said biasing means depending upon a specific kind of said sheets of paper, said pressure adjusting means comprising (a) an elongate pivotable member pivotable about a pivot axis thereof and bearing said spring seat; (b) a plurality of push rods spaced from each other substantially along the length of said elongate pivotable member and movable in directions substantially perpendicular to said length, each of said push rods carrying at one end thereof a push button and biased toward said push button, said push rods including respective engagement portions which are engageable with said pivotable member for pivoting movements thereof to move said spring seat at different positions relative to said paper stacker when said push rods are moved to their operated positions against respective biasing forces upon depression onto the respective push buttons; and (c) detent means for selectively holding the operated one of said push rods at said operated position.

17. A paper feeding apparatus for a printer for impression of characters along a line of printing, comprising:

a frame secured to the printer;

at least one feed roller supported by said frame rotatably to feed individual sheets of paper one after another in a direction perpendicular to said line of printing;

a paper stacker for holding an entire portion of a stack of said sheets, said paper stacker being supported by said frame pivotally between an advanced and a retracted position thereof, and including an engagement portion;

biasing means comprising a spring for biasing said paper stacker toward said advanced position, said spring having one end in abutment on said paper stacker to urge a top sheet of said stack into contact with a periphery of said at least one feed roller, and further comprising a spring seat bearing the other end of said spring;

a manually operated member supported by said frame movably between a first and a second position thereof;

retract-and-latch means, associated with said manually operated member and said paper stacker, for pivoting said paper stacker to said retracted position against a biasing force of said biasing means when said manually operated member is moved from said first position to said second position, said retract-and-latch means including a latch portion which engages said engagement portion of the paper stacker and thereby locks the paper stacker at said retracted position when said manually operated member has been moved to said second position;

unlatch means for disengaging said latch portion of said retract-and-latch means from said engagement portion of the paper stacker to allow said paper stacker to return to said advanced position when said manually operated member is moved from said second position toward said first position; and pressure adjusting means for adjusting a biasing force of said biasing means depending upon a specific kind of said sheets of paper, said pressure adjusting means comprising (a) an elongate pivotable member pivotable about a pivot axis thereof and bearing said spring seat; (b) a plurality of push rods spaced from each other substantially along the length of said elongate pivotable member and movable in directions substantially perpendicular to said length, each of said push rods carrying at one end thereof a push button and biased toward said push button, said push rods including respective engagement portions which are engageable with said pivotable member for pivoting movements thereof to move said spring seat at different positions relative to said paper stacker when said push rods are moved to their operated positions against respective biasing forces upon depression onto the respective push buttons; and (c) detent means for selectively holding the operated one of said push rods at said operated position.

18. A paper feeding apparatus as recited in claim 17, wherein said detent means comprises an elongate movable member longitudinally movable substantially along the length of said pivotable member and having a plurality of extensions spaced from each other along the length thereof, said extensions having hooked ends engageable with said engagement portions of the push rods upon movement of the push rods to their operated positions.

19. A paper feeding apparatus recited in claim 18, wherein said elongate movable member is spring-biased along the length thereof toward one end thereof, said hooked ends having respective inclined surfaces, said engagement portions of the push rods being slidable, upon movement of the rods toward said operated positions, on said inclined surfaces while moving said elongate movable member toward the other end thereof against a biasing force applied thereto, thereby effecting disengagement of the engagement portion of the previously operated push rod from the corresponding hooked end, and effecting engagement of the engagement portion of the currently operated push rod with the corresponding push rod.

* * * * *